US010524576B2

(12) United States Patent
Huang et al.

(10) Patent No.: US 10,524,576 B2
(45) Date of Patent: Jan. 7, 2020

(54) WORK CHAIR

(71) Applicant: HIEVER CO., LTD., Taichung (TW)

(72) Inventors: Tony Huang, Taichung (TW); Jeffery Huang, Taichung (TW)

(73) Assignee: HIEVER CO., LTD., Taichung (TW)

( * ) Notice: Subject to any disclaimer, the term of this patent is extended or adjusted under 35 U.S.C. 154(b) by 0 days.

(21) Appl. No.: 16/238,023

(22) Filed: Jan. 2, 2019

(65) Prior Publication Data

US 2019/0200767 A1 Jul. 4, 2019

(30) Foreign Application Priority Data

Jan. 3, 2018 (TW) ..... 107200090 U

(51) Int. Cl.

| | |
|---|---|
| ***A47C 3/36*** | (2006.01) |
| ***A47C 9/02*** | (2006.01) |
| ***A47C 7/00*** | (2006.01) |
| ***B25H 5/00*** | (2006.01) |

(52) U.S. Cl.

CPC ..... *A47C 3/36* (2013.01); *A47C 7/006* (2013.01); *A47C 9/027* (2013.01); *B25H 5/00* (2013.01)

(58) Field of Classification Search

CPC ..... A47C 3/36; A47C 7/006; A47C 9/027

USPC ..... 280/35, 639, 642; 297/338, 344.15; 403/54, 84

See application file for complete search history.

(56) References Cited

U.S. PATENT DOCUMENTS

| | | | | |
|---|---|---|---|---|
| 5,451,068 | A * | 9/1995 | Shockley | B25H 5/00 280/32.6 |
| 5,611,551 | A * | 3/1997 | Lin | B25H 5/00 280/32.5 |
| 6,095,532 | A * | 8/2000 | Martin | B25H 5/00 280/30 |
| 6,199,877 | B1 * | 3/2001 | Shockley | B25H 5/00 280/32.6 |
| 6,425,590 | B1 * | 7/2002 | Whiteside | B25H 5/00 280/32.5 |
| 6,578,857 | B1 * | 6/2003 | Whiteside | B25H 5/00 280/32.5 |
| 6,834,868 | B1 * | 12/2004 | Blackburn | B25H 5/00 280/32.6 |
| 6,871,861 | B2 * | 3/2005 | Hernandez, Jr. | B25H 5/00 248/129 |
| 6,969,077 | B2 * | 11/2005 | Liu | B25H 5/00 280/30 |

(Continued)

*Primary Examiner* — Paul N Dickson
*Assistant Examiner* — Hilary L Johns
(74) *Attorney, Agent, or Firm* — Muncy, Geissler, Olds & Lowe, P.C.

(57) ABSTRACT

A work chair includes a base frame including a transverse portion, a longitudinal portion vertically located on the transverse portion and a plurality of rollers provided at a bottom side thereof, a first pivoting frame pivotally connected to the transverse portion and biasable between a horizontal position and a vertical position, a second pivoting frame including a bottom support portion and a top support portion. The top support portion has one end thereof pivotally connected to the longitudinal portion of the base frame such that the second pivoting frame can be biased to move the top support portion from a vertical position to a horizontal position where the second pivoting frame is placed across the first pivoting frame.

6 Claims, 10 Drawing Sheets

(56) References Cited

U.S. PATENT DOCUMENTS

| | | | | |
|---|---|---|---|---|
| 7,481,438 | B2 * | 1/2009 | Hernandez | B25H 5/00 280/32.5 |
| 7,658,442 | B1 * | 2/2010 | Whiteside | A47C 7/62 297/188.01 |
| 8,596,651 | B2 * | 12/2013 | Canova | A47C 3/36 280/32.5 |
| 9,126,611 | B2 * | 9/2015 | Liu | B62B 5/067 |
| 9,193,064 | B2 * | 11/2015 | Dall'Armi | B25H 5/00 |
| 9,610,682 | B2 * | 4/2017 | Shaner | B25H 5/00 |
| 9,687,080 | B1 * | 6/2017 | Thiel | A47C 9/10 |
| 10,232,504 | B1 * | 3/2019 | Whiteside | B25H 5/00 |
| 2012/0038122 | A1 * | 2/2012 | Canova | A47C 3/36 280/32.6 |
| 2018/0235369 | A1 * | 8/2018 | Rivera, Jr. | A47C 4/04 |
| 2019/0200766 | A1 * | 7/2019 | Huang | A47C 3/36 |
| 2019/0200767 | A1 * | 7/2019 | Huang | A47C 3/36 |

* cited by examiner

WORK CHAIR

BACKGROUND OF THE INVENTION

1. Field of the Invention

The present invention relates to work chairs for use in maintenance works and more particularly, to such a work chair that can be adjusted to change the height of the seat.

2. Description of the Related Art

Generally, when performing a maintenance work, such as automobile repair, it takes a long time to squat down or to sit on the floor. In order to make the maintenance personnel have a more comfortable posture, the maintenance personnel usually will use a work chair. For example, U.S. Pat. No. 8,596,651 disclosed a work seat that is provided with rollers at the bottom side thereof facilitating movement by the maintenance personnel and can be adjusted to change the height according to different application needs. Further, U.S. Pat. No. 5,451,068 discloses a transformable mechanic's creeper, which is transformable between a horizontal creeper and an upright seat. Of course, there are some work chairs that use a pneumatic actuator to change the height of the seat cushion. However, this work chair is limited by the length of the pneumatic actuator, so it cannot be lowered to a very low level.

SUMMARY OF THE INVENTION

The present invention has been accomplished under the circumstances in view. It is the main object of the present invention to provide a work chair that can be adjusted to change the height of the seat by a simple folding operation.

To achieve this and other objects of the present invention, a work chair comprises a base frame including a transverse portion, a longitudinal portion vertically located on the transverse portion and a plurality of rollers provided at a bottom side thereof, a first pivoting frame pivotally connected to the transverse portion and biasable between a horizontal position and a vertical position, a second pivoting frame including a bottom support portion and a top support portion, and two seat cushions respectively mounted on the top support portion and bottom support portion of the second pivoting frame. The top support portion has one end thereof pivotally connected to the longitudinal portion of the base frame such that the second pivoting frame can be biased to move the top support portion from a vertical position to a horizontal position where the second pivoting frame is placed across the first pivoting frame.

Other advantages and features of the present invention will be fully understood by reference to the following specification in conjunction with the accompanying drawings, in which like reference signs denote like elements, components, objects, structures, systems, architectures, devices, processes, methods, or steps.

DETAILED DESCRIPTION OF THE INVENTION

Figure 1:
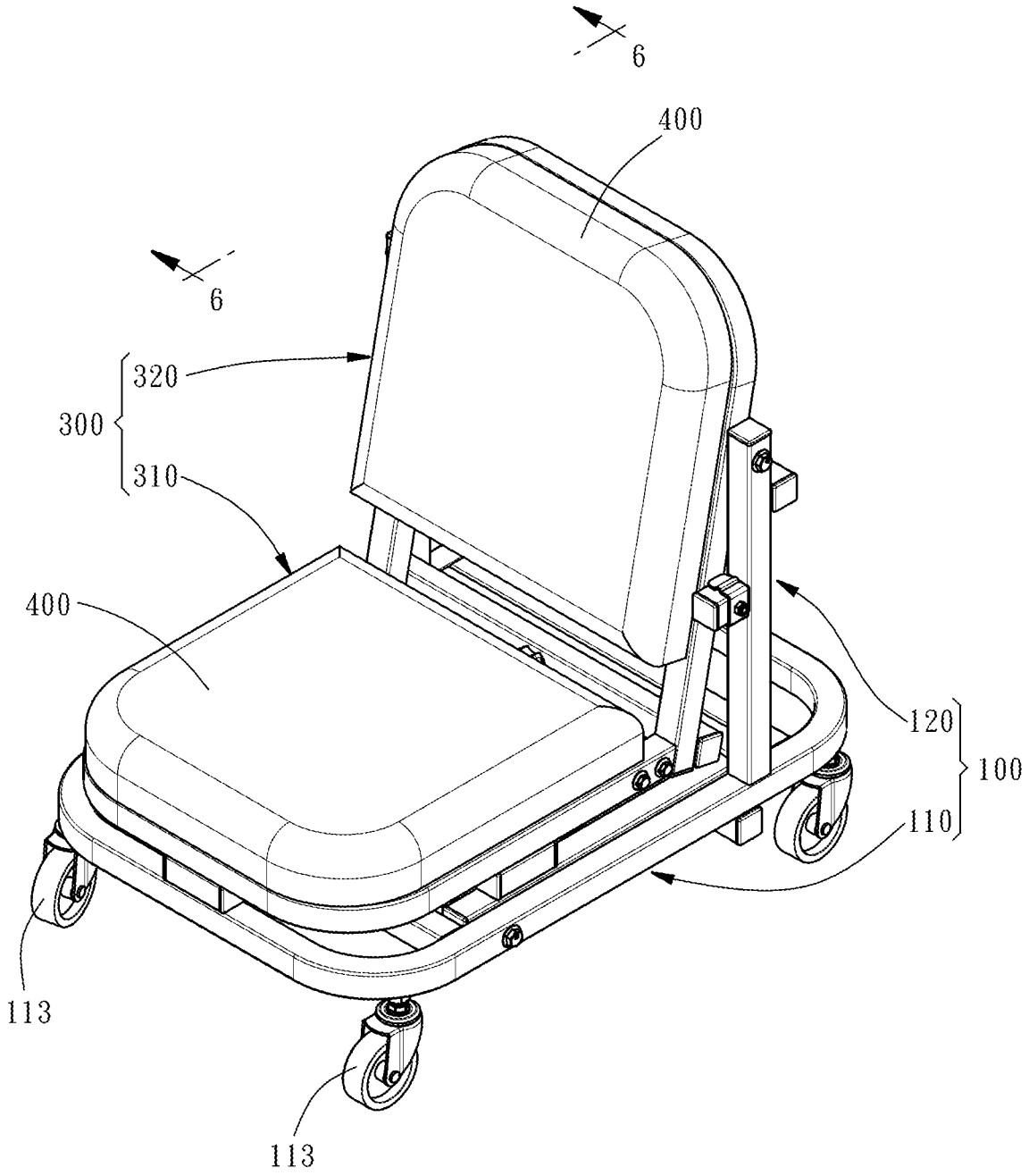
FIG. 1 is an oblique top elevational view of a work chair in accordance with the present invention.

Referring to FIGS. 1-4, a work chair in accordance with the present invention is shown. The work chair comprises a base frame (100), a first pivoting frame (200), a second pivoting frame (300), and two seat cushions (400).

The base frame (100) comprises a transverse portion (110) and a longitudinal portion (120). The transverse portion (110) includes two Outer frame (111) and three X bars (112). The three X bars (112) are respectively connected to the outer frame (111) with their two ends. The bottom surface of the transverse portion (110) of the base frame (100) is provided with a plurality of rollers (113), so that the base frame (100) can be placed on a support surface, such as a floor, and can be moved by scrolling of the rollers (113). The longitudinal portion (120) is erected on the transverse portion (110), comprising two Y bars (121) and two X bars (122). The two X bars (122) are respectively connected to the two Y bars (121) with their two ends. The two Y bars (121) of the longitudinal portion (120) have respective one ends thereof respectively affixed to the outer frame (111) of the transverse portion (110).

The first pivoting frame (200) is pivotally connected to the transverse portion (110) of the base frame (100), comprising two Y bars (201) and two X bars (202). The two X bars (202) are respectively connected to the two Y bars (201) with their two ends. The two Y bars (201) of the first pivoting frame (200) have respective one ends thereof respectively pivotally connected to the outer frame (111) of the transverse portion (110) of the base frame (100) so that the two Y bars (201) of the first pivoting frame (200) are disposed within the outer frame (111) of the transverse portion (110) of the base frame (100) and the first pivoting frame (200) can be rotated with the two pivot points (J1) as a rotating shaft from an original horizontal position to an vertical position.

The second pivoting frame (300) is pivotally connected to the longitudinal portion (120) of the base frame (100) with one end thereof, comprising a bottom support portion (310) and a top support portion (320). The bottom support portion (310) and the top support portion (320) define therebetween a contained angle such that the lateral side of the second pivoting frame (300) exhibits a L-shaped profile. The bottom support portion (310) comprises an outer frame (311) and an X bar (312). The top support portion (320) comprises an outer frame (321) and an X bar (322). Further, a M bar (323) is disposed in the junction between the bottom support portion (310) and the top support portion (320). In the present preferred embodiment, the M bar (323) is located on the top support portion (320). The M bar (323) is connected to the outer frame (321) of the top support portion (320) with the two ends thereof. However, this mounting arrangement is not a limitation. Alternatively, the M bar (323) can be mounted to the outer frame (311) of the bottom support portion (310). The second pivoting frame (300) is pivotally connected to the Y bars (121) of the longitudinal portion (120) of the base frame (100) with one end of the top support portion (320) so that the second pivoting frame (300) can be rotated with the two pivot points (J2) as a rotating shaft and then supported on the first pivoting frame (200).

The two seat cushions (400) are respectively mounted on the top support portion (320) and bottom support portion (310) of the second pivoting frame (300).

With the above structure, the work chair can provide two different heights of use. The first height of use is as shown in FIGS. 1-4, where the first pivoting frame (200) and the second pivoting frame (300) are not rotated, so the first pivoting frame (200) is in the horizontal position, and the bottom support portion (310) of the second pivoting frame (300) is attached to the first pivoting frame (200) to keep the top support portion (320) in vertical. At this time, the maintenance personnel can sit on the seat cushion (400) at the bottom support portion (310) and the seat cushion (400) at the top support portion (320) can be used as a backrest to support the back of the maintenance personnel. The overall height of the work chair in this first height of use is in a state close to the ground.

Figure 7:
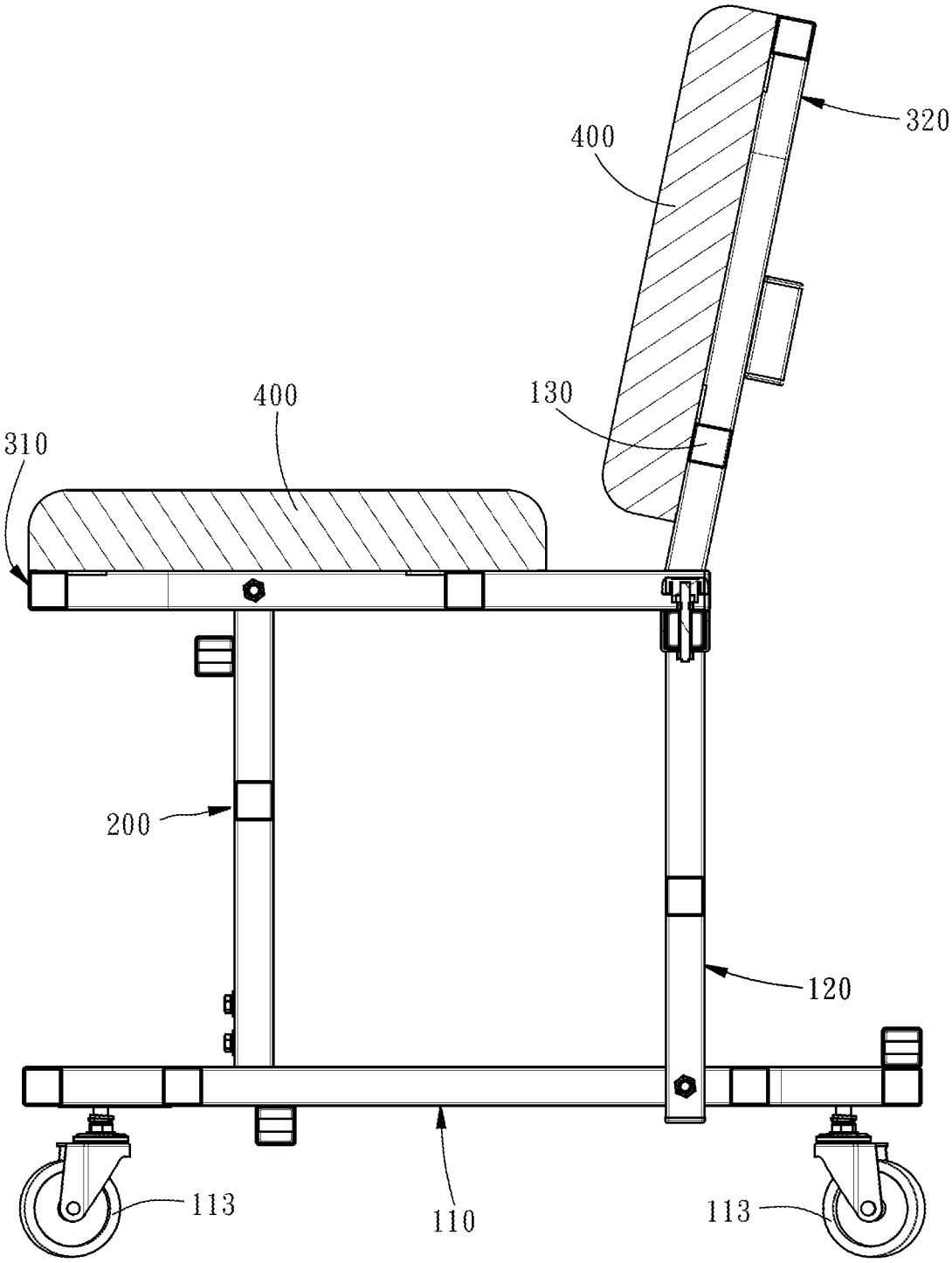
FIG. 7 is similar to FIG. 6, illustrating the height of the work chair adjusted.

When changing the height of use, first turn the second pivoting frame (300) upwardly from the original vertical position to the horizontal position, as shown in FIG. 7. Then, turn the first pivoting frame (200) upwardly from the original horizontal position to the vertical position, enabling the second pivoting frame (300) to be placed across the first pivoting frame (200). In this way, the seat cushion (400) at the top support portion (320), which was originally used as a backrest, is transformed into a seat cushion for sitting by the maintenance personnel, and the seat cushion (400) at the bottom support portion (310), which was originally used as a seat, is transformed into a backrest for supporting the back of the maintenance personnel. Thus, the seat height of the entire work chair is changed from the original low position to a high position to provide the second height of use.

Figure 8:
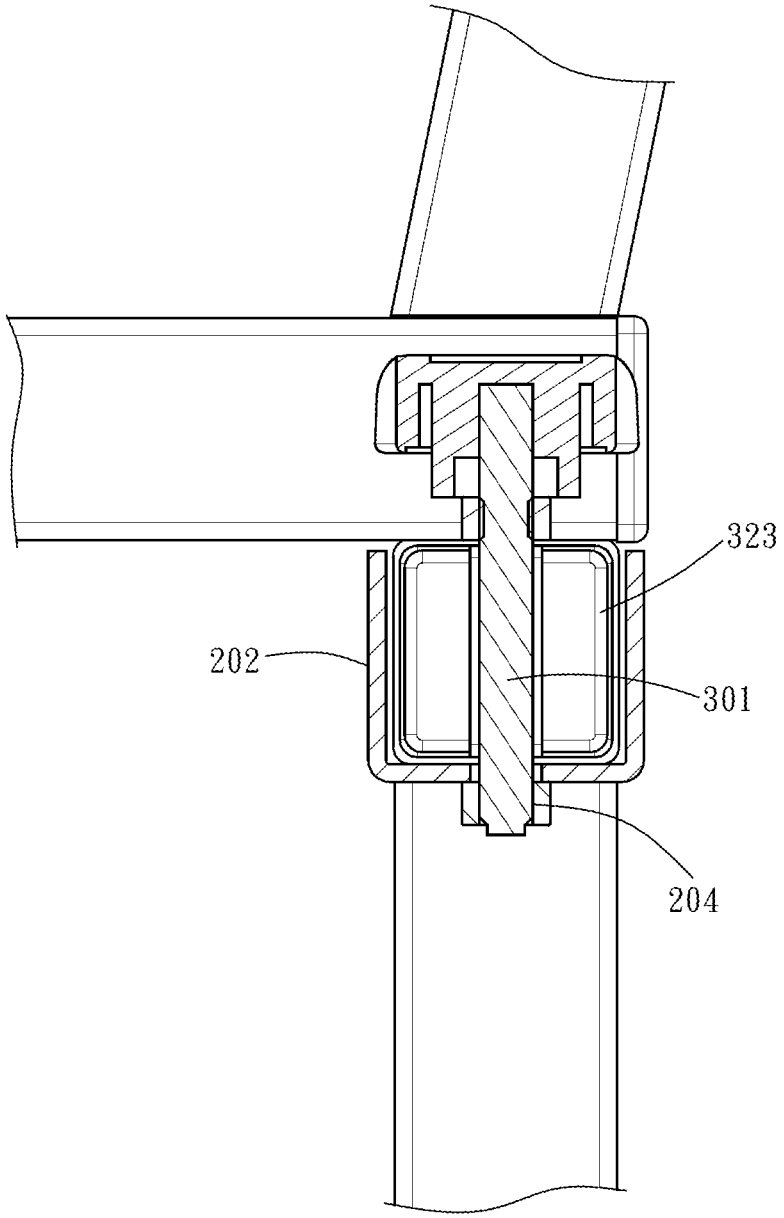
FIG. 8 is an enlarged view of a part of FIG. 7, illustrating the connection part between X bar of the first pivoting frame and the M bar of the second pivoting frame.

In order to further improve the stability of use, the X bar (202) of the first pivoting frame (200) near the longitudinal portion (120) of the base frame (100) is provided with a groove (203) so that this X bar (202) is shaped like a channel bar having a substantially U-shaped cross section for accommodating the M bar (323) of the second pivoting frame (300). Further, the second pivoting frame (300) is provided with a first locating member (301), and the first pivoting frame (200) is provided with a first locating portion (204). Engagement between the first locating member (301) and the first locating portion (204) can make the second pivoting frame (300) more stable when it is placed on the first pivoting frame (200). In this embodiment, the first locating member (301) is a screw bolt, and the first locating portion (204) is a screw hole. By means of threading the screw bolt into the screw hole, the second pivoting frame (300) is locked to the first pivoting frame (200) to enhance the positioning stability, as shown in FIGS. 7 and 8. Of course, the locking method between the first and second pivoting frames is not limited thereto, and other locking methods such as pin locking or clamp clamping may be used.

Figure 9:
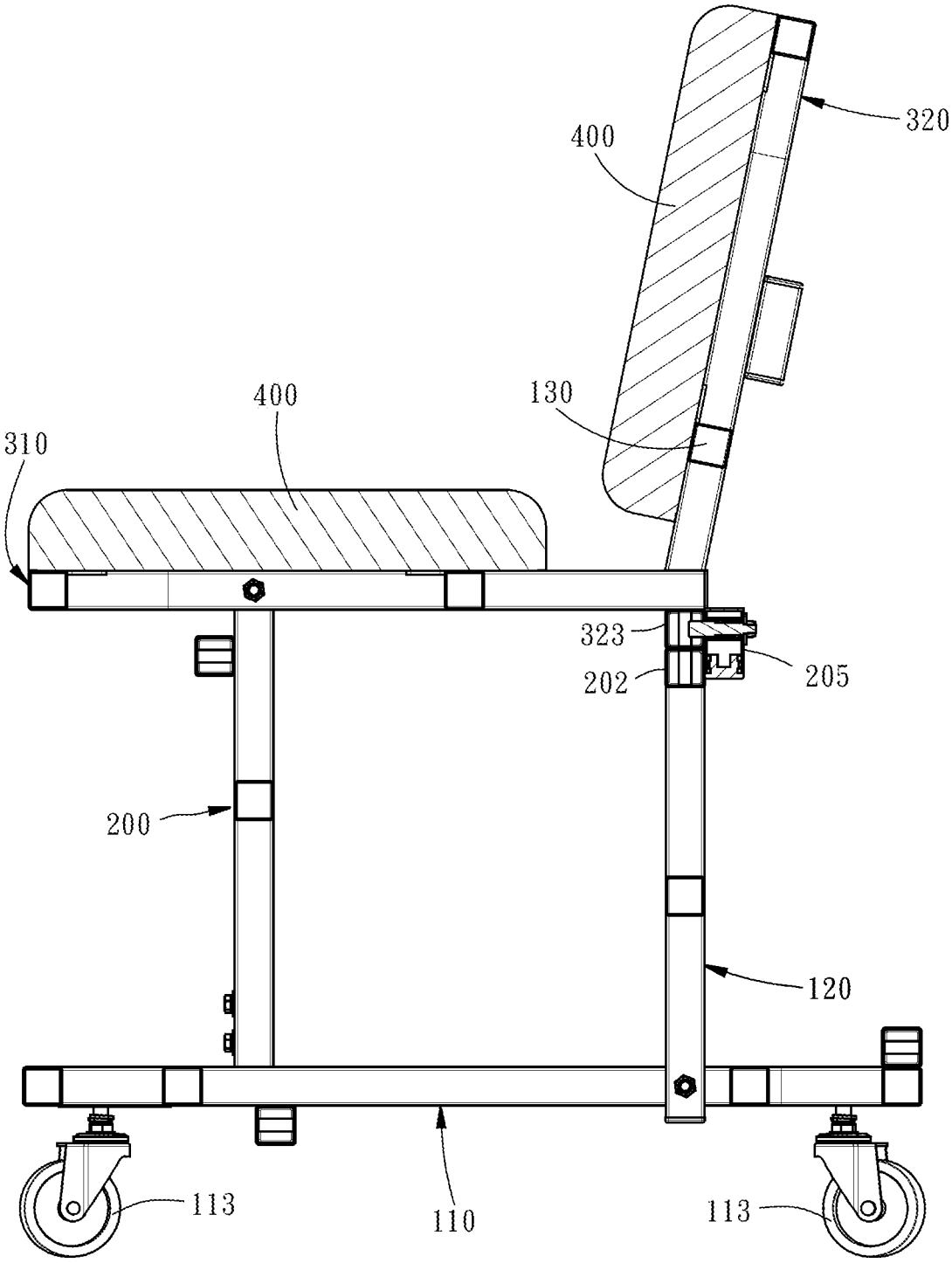
FIG. 9 is similar to FIG. 6, illustrating the second embodiment of the height of the work chair adjusted.
Figure 10:
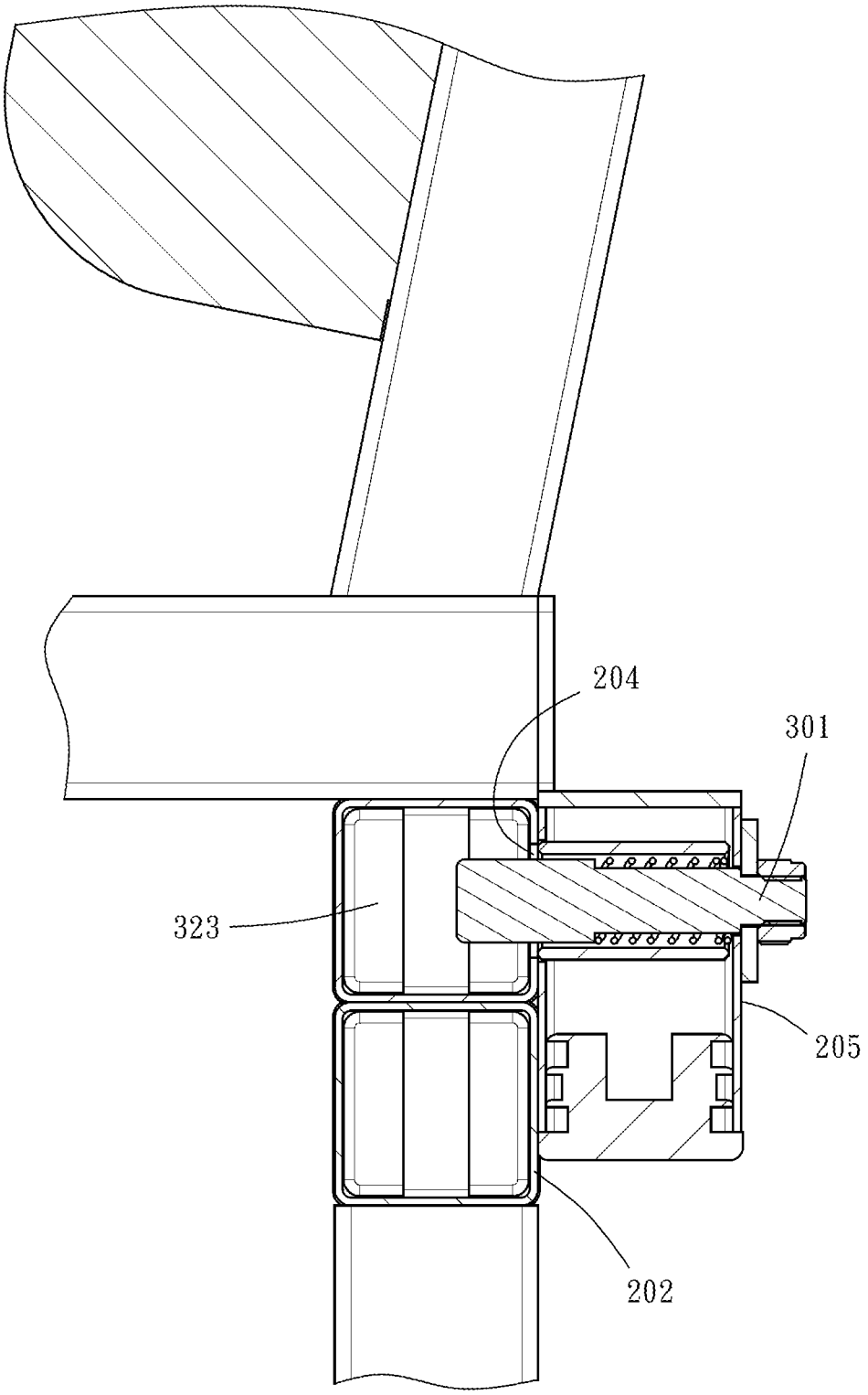
FIG. 10 is an enlarged view of a part of FIG. 9, illustrating the second embodiment of the connection part between X bar of the first pivoting frame and the M bar of the second pivoting frame.

There is more than one way to fix the first pivoting frame (200) and the second pivoting frame (300). In the second embodiment of present invention, the location of the first locating member (301) and the first locating portion (204) can switch as shown in FIG. 9 and FIG. 10. A block (205) is provided on the X bar (202) and extended upward and the first locating member (301) is provided on the block (205). The M bar (323) is provided with a first locating portion (204). In this embodiment, the first locating member (301) is a locating pin provided on the block (205) and the first locating portion (204) is a pin hole located on the M bar (323).

Figure 2:
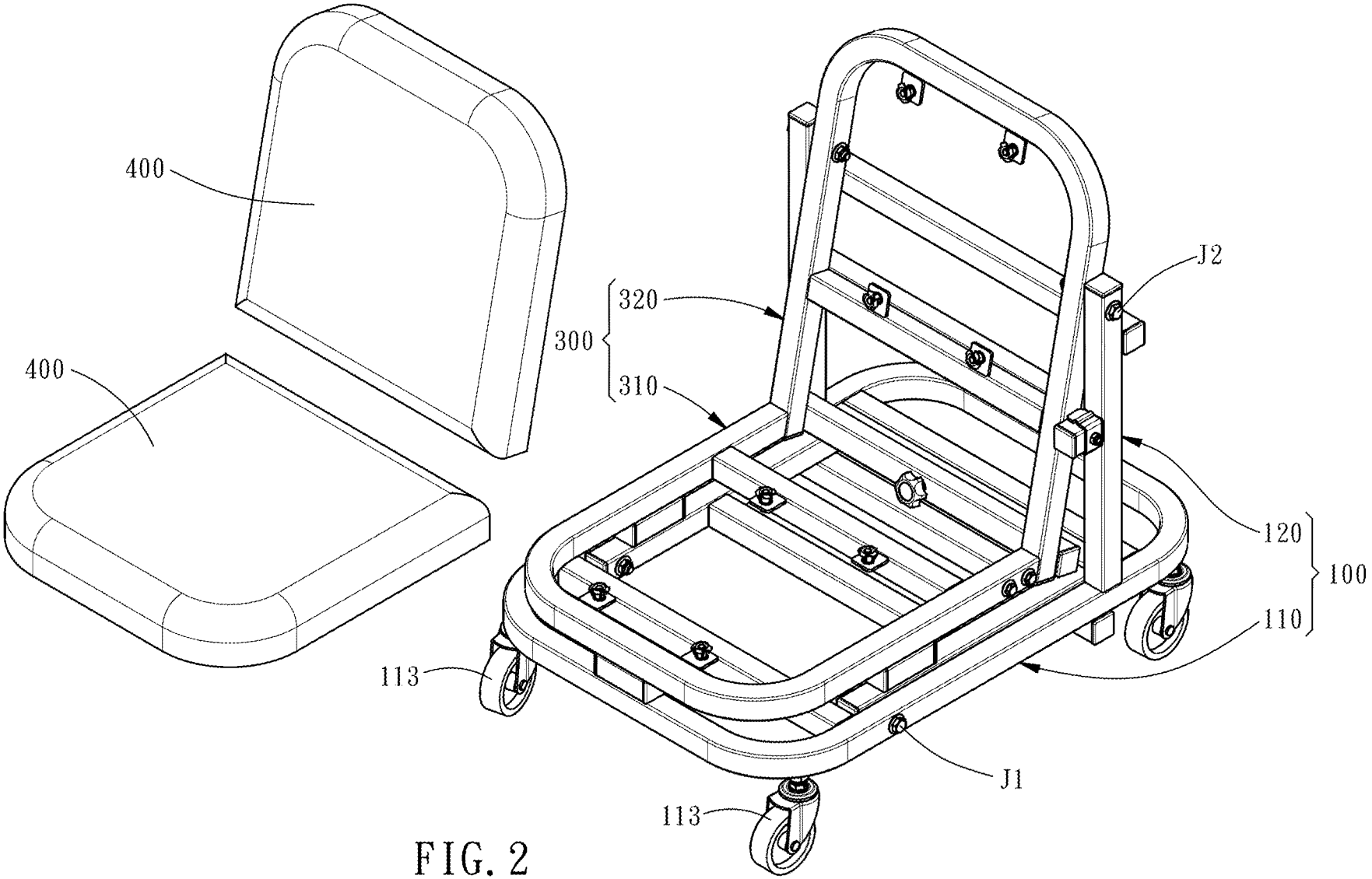
FIG. 2 is an elevational view of the present invention after detachment of the seat cushions from the second pivoting frame.
Figure 3:
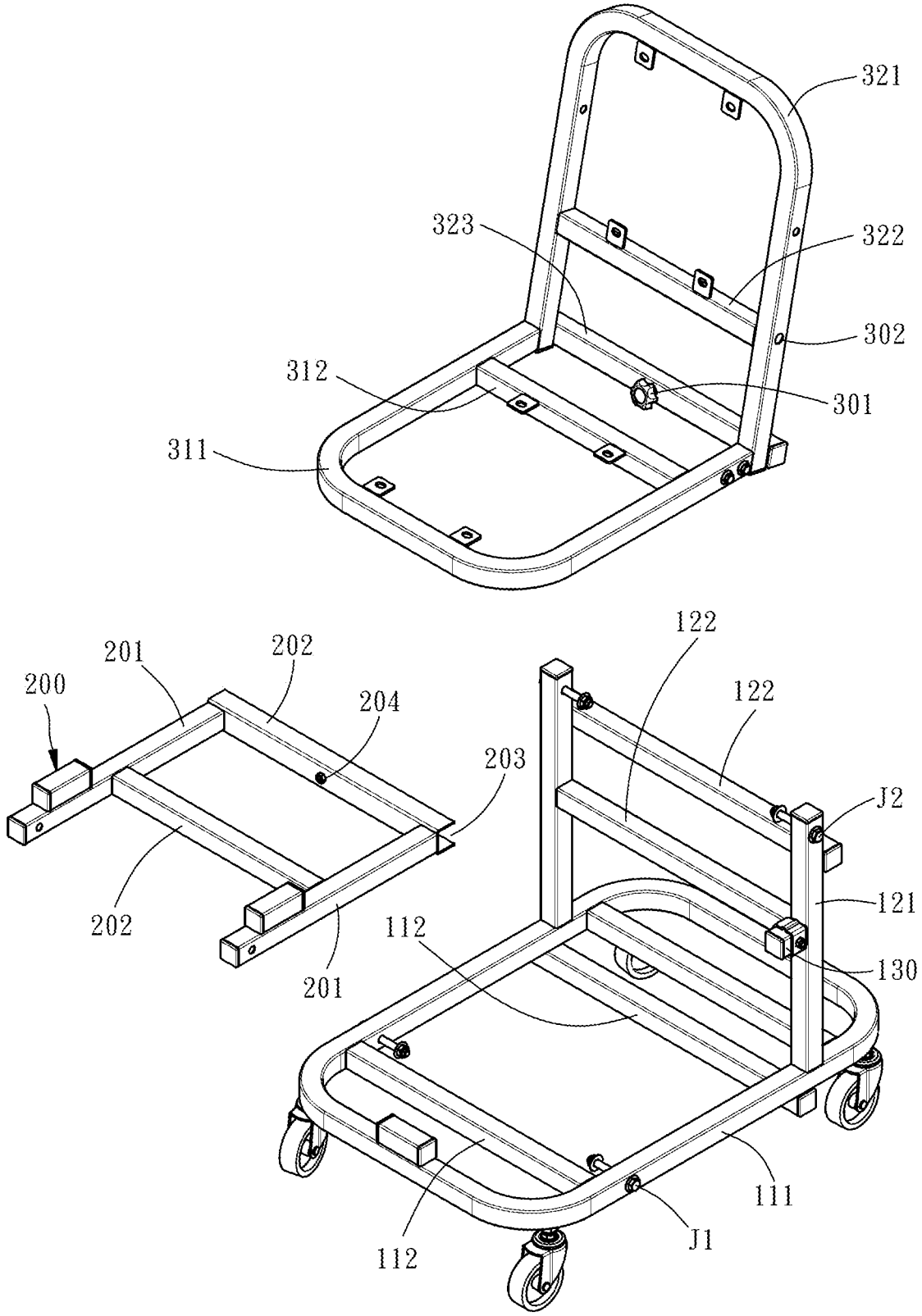
FIG. 3 is an exploded view of the work chair in accordance with the present invention after removal of the seat cushions.
Figure 4:
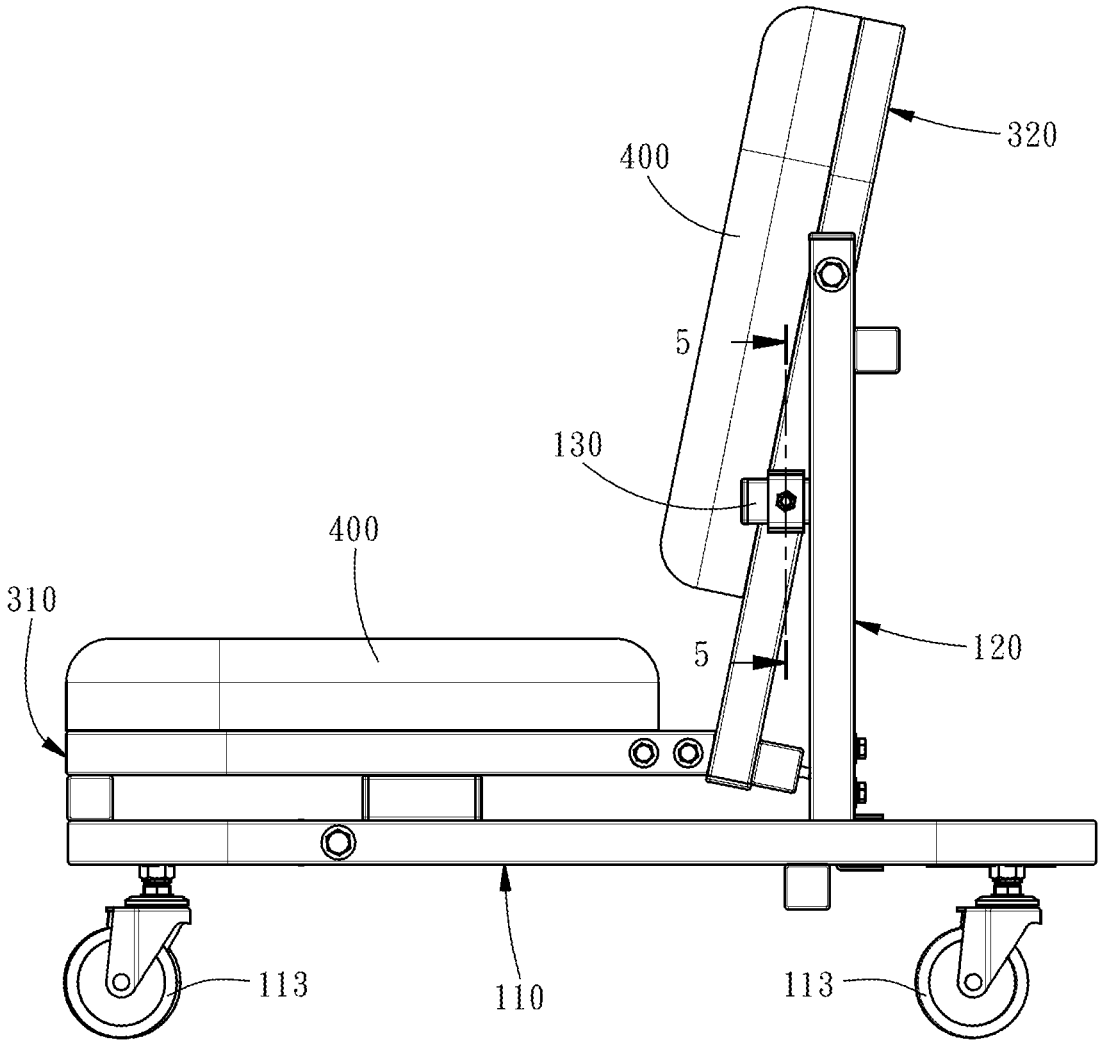
FIG. 4 is a side view of the work chair in accordance with the present invention.
Figure 5:
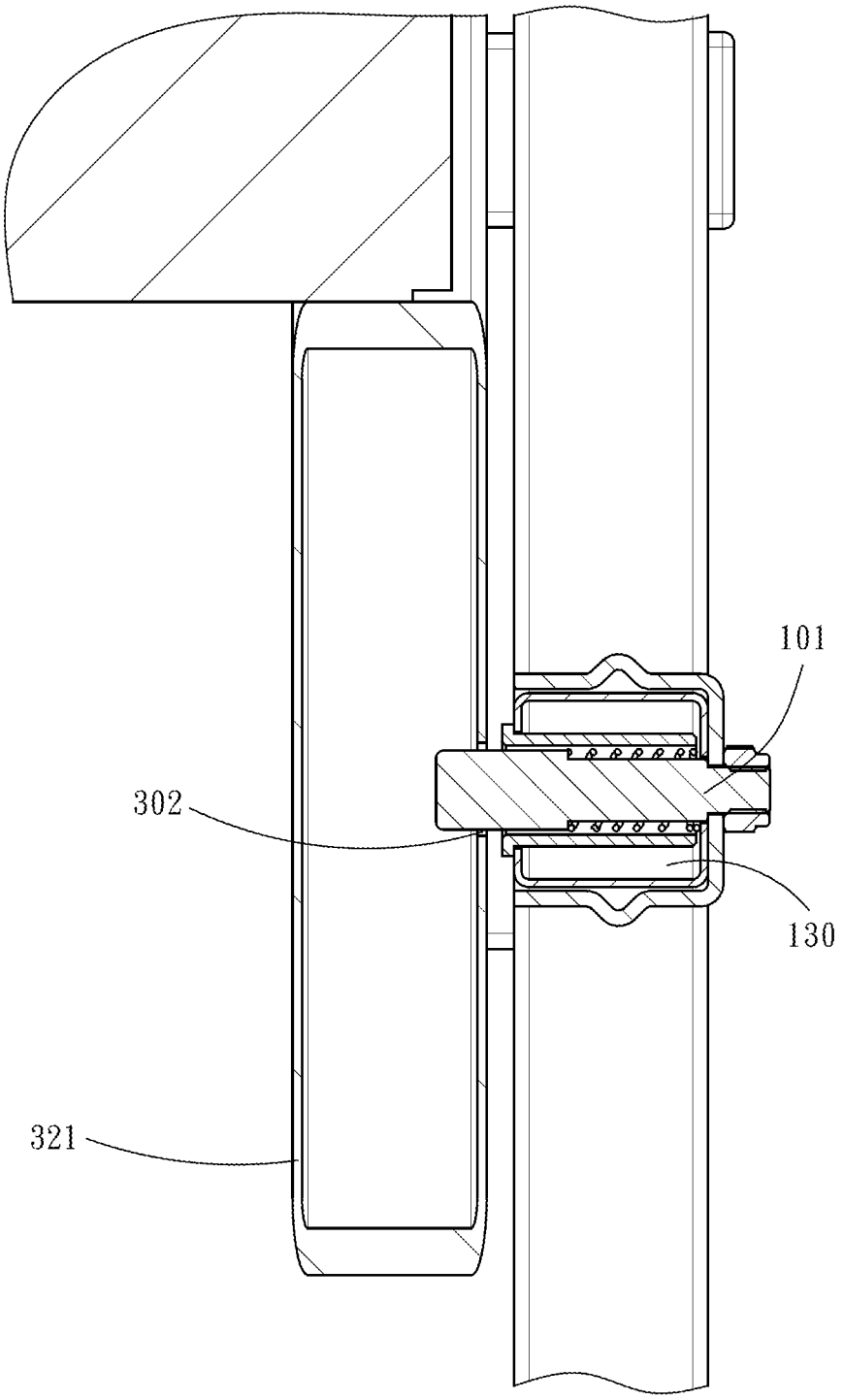
FIG. 5 is a sectional view taken along line 5-5 of FIG. 4.
Figure 6:
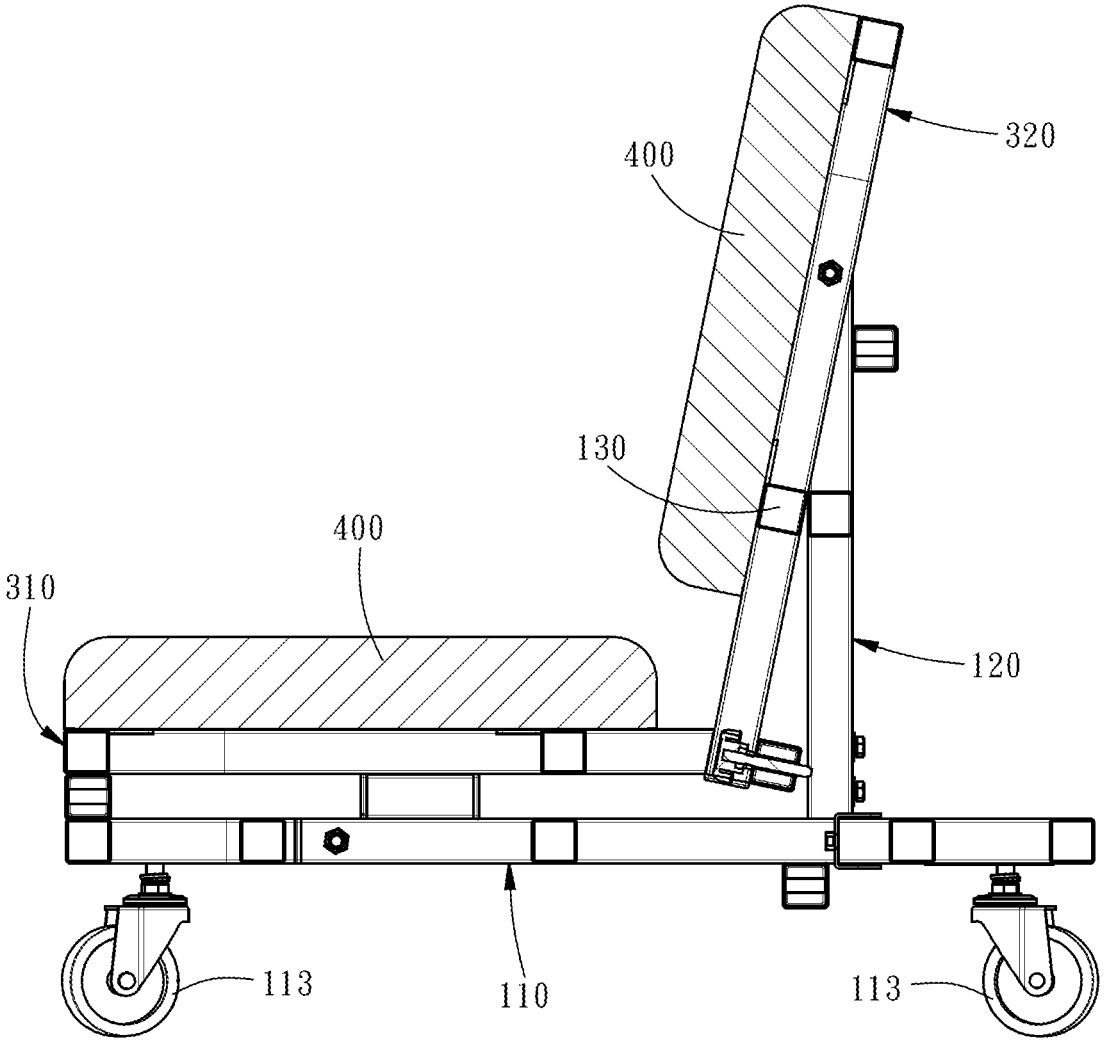
FIG. 6 is a sectional view taken along line 6-6 of FIG. 1.

Further, the base frame (100) is provided with a second locating member (101); the second pivoting frame (300) is provided with a second locating portion (302) for the fastening of the second locating member (101). In this embodiment, the second locating member (101) is a locating pin provided at an upright (130) of the longitudinal portion (120) of the base frame (100), and the second locating portion (302) is a pin hole located on the outer frame (321) of the top support portion (320) of the second pivoting frame (300), as shown in FIG. 2 and FIG. 5. By means of plugging the second locating member (101) into the second locating portion (302), the second pivoting frame (300) is prohibited from biasing relative to the base frame (100).

What is claimed is:

1. A work chair, comprising:

a base frame comprising a transverse portion, a longitudinal portion and a plurality of rollers provided at a bottom side of said transverse portion for supporting said base frame on the floor or a supporting surface for allowing movement of said base frame on said floor or said supporting surface by scrolling said rollers, said longitudinal portion being vertically located on said transverse portion;

a first pivoting frame pivotally connected to said transverse portion of said base frame and biasable relative to said base frame between a horizontal position and a vertical position;

a second pivoting frame comprising a bottom support portion, a top support portion and a M bar provided between said bottom support portion and said top support portion, said bottom support portion and said top support portion being connected together with a predetermined contained angle defined therebetween, said top support portion having one end thereof pivotally connected to said longitudinal portion of said base frame so that said second pivoting frame is biasable from a longitudinal position to a horizontal position where said second pivoting frame is placed across said first pivoting frame; and two seat cushions respectively mounted on said top support portion and said bottom support portion of said second pivoting frame;

wherein said first pivoting frame comprises a first locating portion and said second pivoting frame comprises a first locating member adapted for fastening to said first locating portion to lock said second pivoting frame to said first pivoting frame after said second pivoting frame is placed across said first pivoting frame.

2. The work chair as claimed in claim 1, wherein said transverse portion comprises an outer frame and a plurality of X bars connected to said outer frame with respective opposite ends thereof; said longitudinal portion comprises two Y bars and a plurality of X bars connected to said Y bars with respective opposite ends thereof, said two Y bars of said longitudinal portion having respective one ends thereof affixed to said outer frame of said transverse portion.

3. The work chair as claimed in claim 2, wherein said first pivoting frame comprises two Y bars and a plurality of X bars connected to said Y bars of said first pivoting frame with respective opposite ends thereof, said Y bars of said first pivoting frame having respective one ends thereof pivotally connected to said outer frame of said transverse portion of said base frame such that said two Y bars of said first pivoting frame are disposed within said outer frame of said transverse portion of said base frame.

4. The work chair as claimed in claim 2, wherein said bottom support portion and said top support portion of said second pivoting frame each comprise an outer frame and an X bar; said M bar has two opposite ends thereof respectively connected to said outer frame of said top support portion.

5. The work chair as claimed in claim 1, wherein said first pivoting frame comprises two Y bars and a plurality of X bars connected to said Y bars of said first pivoting frame with respective opposite ends thereof, the said X bar of said first pivoting frame near said longitudinal portion of said base frame being provided with a groove and having a U-shaped cross section adapted for accommodating said M bar of said second pivoting frame.

6. The work chair as claimed in claim 5, wherein said first pivoting frame comprises a first locating portion and said second pivoting frame comprises a first locating member adapted for fastening to said first locating portion to lock said second pivoting frame to said first pivoting frame after said second pivoting frame is placed across said first pivoting frame.

* * * * *